US006582320B2

(12) United States Patent
Fendel

(10) Patent No.: US 6,582,320 B2
(45) **Date of Patent: *Jun. 24, 2003**

(54) HYBRID GOLF CLUB SHAFT

(76) Inventor: Edwin B. Fendel, 487 Pepperidge Tree Ter., Kinnelon, NJ (US) 07405

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/248,569

(22) Filed: Feb. 11, 1999

(65) Prior Publication Data

US 2001/0001772 A1 May 24, 2001

Related U.S. Application Data

(63) Continuation-in-part of application No. 08/870,625, filed on Jun. 6, 1997.

(60) Provisional application No. 60/074,435, filed on Feb. 11, 1998, provisional application No. 60/103,375, filed on Oct. 7, 1998, and provisional application No. 60/109,707, filed on Nov. 24, 1998.

(51) Int. Cl.[7] ..... A63B 53/02; A63B 53/10; A63B 53/12

(52) U.S. Cl. ..... 473/312; 473/320

(58) Field of Search ..... 473/316–323, 473/298, 299, 312

(56) References Cited

U.S. PATENT DOCUMENTS

| | | | | |
|---|---|---|---|---|
| 2,023,131 | A | * | 12/1935 | Gibson |
| 4,169,595 | A | | 10/1979 | Kaugars |
| 4,240,631 | A | * | 12/1980 | MacDougall |
| 4,682,504 | A | * | 7/1987 | Kobayashi |
| 4,836,545 | A | * | 6/1989 | Pompa |
| 5,018,735 | A | * | 5/1991 | Meredith |
| 5,022,652 | A | * | 6/1991 | Fenton |
| 5,184,819 | A | * | 2/1993 | Desbiolles |
| 5,253,867 | A | * | 10/1993 | Gafner |
| 5,465,959 | A | * | 11/1995 | Cheng |
| 5,575,473 | A | * | 11/1996 | Turner |
| 5,971,865 | A | * | 10/1999 | Shenoha |

* cited by examiner

*Primary Examiner*—Stephen Blau
(74) *Attorney, Agent, or Firm*—Synnestvedt & Lechner LLP

(57) ABSTRACT

A golf shaft for attachment to a hossel of a club head, said shaft comprising: (a) a first section comprising a first material and having a hossel end and a first joint end, said first section having a linear weight no greater than 2.4 g/in; (b) a second section comprising a second material and having a butt end and a second joint end, said second joint end being connected to said first joint end; (c) wherein said second material is less dense than said first material; and (d) wherein said first material has a shear modulus greater than that of said second material.

31 Claims, 5 Drawing Sheets

HYBRID GOLF CLUB SHAFT

REFERENCE TO RELATED APPLICATIONS

This application is a continuation-in-part of co-pending U.S. application Ser. No. 08/870,625 filed on Jun. 6, 1997, which is hereby incorporated by reference, and also is based on Provisional Application No. 60/074,435, filed on Feb. 11, 1998, Provisional Application No. 60/103,375, filed on Oct. 7, 1998, and Provisional Application No. 60/109,707 filed on Nov. 24, 1998, all of which are hereby incorporated by reference.

FIELD OF INVENTION

This invention relates generally to golf clubs and, more particularly, to a hybrid shaft for improving the performance of golf clubs.

STATEMENT OF PROBLEM ADDRESSED BY INVENTION

A modern golf club typically comprises a head connected to a shaft, and a gripping region disposed on the end of the shaft opposite the head. Perhaps more than any other component, the shaft affects overall club performance. It is generally accepted that the optimum golf club shaft should have the following characteristics: (1) lightweight for high swing velocity; (2) high torsional stiffness to limit unwanted angular deflection of the head about the shaft; (3) configurable bending stiffness; (4) moderate high swing weights; and (5) energy-absorbing ability to soften shocks from miss-hits and ground strikes. These characteristics are described below in greater detail.

1. Lightweight

All golfers benefit from a lightweight club. A lightweight club will have greater acceleration for the same applied force than a heavier club. Greater acceleration equates to a higher swing velocity. Swing velocity is an important factor in driving a ball: for clubs of similar weight and mass distribution, the greater the swing velocity, the farther the ball will travel. Therefore, lighter clubs are preferable from the perspective of swing velocity.

2. High Torsional Stiffness

All golfers benefit from a torsionally-stiff shaft. The center of mass of a club head is offset from the axis of the shaft. Thus, when the club head is accelerated during the swing, inertial forces will tend to rotate the club head about the shaft axis, twisting the shaft elastically in inverse proportion to the shaft's torsional stiffness. As a result, the face of the club head does not meet the ball squarely; rather, the club head "toes" outward thereby meeting the ball at an angle. This causes the ball's flight to veer from a straight path. It is thus desirable to have the shaft as torsionally stiff as practicable to limit the adverse effects of club head rotation The torsional stiffness of a hollow, closed section such as used for golf club shafts is proportional to both the polar moment of inertia of the section and the shear modulus of the material forming the shaft. For example, larger diameter shafts have larger polar moments of inertia and are significantly stiffer in torsion than smaller diameter sections formed from the same material. Likewise shafts formed from a material such as steel, which has a relatively high shear modulus, are inherently stiffer in torsion than a shaft with the same dimension formed from graphite which has a lower shear modulus.

3. Moderate Swing Weight

Swing weight is a measure of how the mass is distributed on a club and equates to the dynamic characteristics or "feel" of the club. Different clubs having different lengths and weights but having the same or similar swing weight will feel the same to the golfer when swung. To achieve consistent play it is important that the various clubs feel the same or at least closely similar during the swing. The swing weight parameter allows a golfer to assemble a set of clubs best suited to his particular needs by matching the dynamic characteristics (the feel) of the various clubs in the set for consistency of feel and play by matching club swing weights.

Weight concentrated toward the head of the club will tend to increase swing weight while weight concentrated toward the butt end of a club tends to decrease swing weight. Swing weight is measured on a scale for A–F, with A being the lightest swing weight and F being the heaviest. Although some golfers prefer heavy swing weights, most prefer moderate swing weights in the range of D–E.

4. Configurable Bending Stiffness

It is important to match the bending stiffness of the club to the abilities of the player. Professional golfers who are able to generate relatively high swing velocity for maximum driving distance tend to prefer clubs having a relatively high bending stiffness. On the other hand, those golfers who generate lower swing velocity tend to prefer a club with relatively low bending stiffness to take advantage of the "kick" resulting from the flexing of the shaft during the early part of the swing and the subsequent release as the golf club head squares with the ball. Thus, it is desirable to have a golf club design which affords a wide range of bending stiffness to accommodate the different needs of various players.

5. Vibration Damping

A club should absorb shock and vibration caused by the head striking the ball and/or ground. Absent such dampening, the shock is transmitted up the shaft and to the user's hands. This can be problematic, especially for those troubled with arthritis.

Conventional Golf Club Design

Conventional club shaft designs have addressed a few of the club characteristics noted above, although no one shaft design has satisfactorily addressed all of these important characteristics. The applicants are aware of essentially three conventional shaft designs: (1) a steel shaft; (2) a graphite shaft; and (3) a hybrid shaft of graphite and steel. Although these designs offer certain advantages, they tend to optimize some of the characteristics mentioned above while compromising others as described below.

1. Steel Shaft

The steel shaft has long been the mainstay of golf club design. The steel shaft provides several advantages. Steel has a high shear modulus which results in shafts having an inherently high torsional stiffness which greatly limits undesired club head rotation or toe out. A wide range of bending stiffness and swing weights can be obtained with the steel shaft by controlling the relative lengths of the smaller diameter sections of the shaft near the club head, with a more flexible shaft being provided by increasing the lengths of the more flexible, smaller diameter sections while reducing the lengths of the relatively stiffer, larger diameter sections. Steel is also durable, strong, inexpensive to manufacture, and provides great consistency of characteristics from one shaft to another.

Unfortunately, steel is dense, and clubs having steel shafts are heavy, have relatively poor acceleration and consequently a lower swing velocity. Additionally, The conventional rubber grip used with the steel shaft also contributes to the weight problem. It is a relatively heavy part of the club, representing, for example, about 15% of the total mass of a typical driver or any fairway wood. These effects are amplified for an oversized grip which are used commonly by people with arthritis or large hands.

Aside from being heavy, steel shafts also tend not to absorb or dampen vibration. Consequently, shocks tend to be transferred from the club head to the user's hands along the shaft.

Thus, although the steel shaft has some advantages, the main advantages being its wide range of bending stiffness and its high torsional stiffness, it also has serious disadvantages of being heavy and poor at absorbing or dampening shock and vibration.

2. Graphite Shaft

Clubs with composite shafts such as graphite are an improvement over steel-shafted clubs in two respects: (1) graphite is substantially less dense than steel yielding a significantly lighter shaft; and (2) a graphite shaft can absorb shock and vibration much better than a steel shaft. A lighter shaft reduces the overall weight of the club and results in higher swing velocity, which produces longer drives as explained above.

The lightweight nature of the graphite shafts are enhanced by the elimination of the rubber grip. A gripless graphite shaft does not have a separate element forming the grip, but rather, the grip is an integral part of the shaft formed by wrapping the graphite over a conically shaped mandrel having a relatively large diameter over a predetermined length at the butt end of the club. The butt end of the shaft thus has a tapered cross section and acts like the conical wedge of the conventional rubber grip to provide a comfortable and secure grip to the golfer. The shaft butt is wrapped over the length of the enlarged diameter with a thin plastic tape to form a frictional gripping surface.

The primary drawbacks of the composite graphite design are its high bending stiffness and low torsional stiffness which is a result of how the shaft is fabricated. In order to achieve the necessary bending strength and light weight of the shaft, unidirectional graphite fibers bound in a resin matrix are helically wrapped or wound around a mandrel in layers which are then cured under heat and pressure to form the shaft. The fibers are wrapped at a relatively high helix angle which orients the fibers as closely as practicable along the length of the shaft to take advantage of the high tensile strength of the graphite fibers and provide strength in bending. However, such large helical wrap angles result in low torsional rigidity largely because the fibers are not oriented circumferentially and therefore cannot effectively resist torsional deflections of the shaft.

The characteristic inaccuracy associated with graphite shafts can be mitigated by angling the face of the golf club's head in a direction opposite of the shaft's twist. For example, the club face would have a counterclockwise angle for a right-handed club. This angle compensates for the shaft's torsional twist such that, upon impact, the club's momentum transfers substantially squarely to the ball. Such compensation, however, is imprecise. The amount of compensation varies not only according to the user, but also according to the strength of a user's particular swing. Consequently, serious golfers prefer not to rely on such compensation. In general, professional golfers do not use graphite shaft clubs but rather continue to use clubs with steel shafts.

Although the graphite shaft provides advantages such as the ability to absorb the shock and vibration of miss-hit balls or ground strikes and a lighter weight club resulting in higher swing velocity, the low torsional stiffness and high bending stiffness of the club presents serious disadvantages which most professional golfers find unacceptable.

3. Hybrid Shaft

Although not commercialized, a hybrid shaft disclosed in Pompa, U.S. Pat. No. 4,836,545, combines the advantages of lightweight and good vibration damping associated with a graphite shaft with the advantages bending flexibility and torsional stiffness of a steel shaft by joining together a graphite butt end shaft section with a steel head end shaft section.

Unfortunately, it has been found that a club of this design has an unacceptably-high swing weight. More specifically, the weight of the hybrid shaft club is concentrated at the head end since the shaft near the club comprises a heavy conventional steel section while the shaft near the butt end comprises a lightweight graphite section. As mentioned above, a high swing weight gives a club a "heavy," undesirable feel in the user's hands. Thus, for the hybrid shaft, the advantage of reduced overall club weight, good shock and vibration absorption, and high torsional has been achieved at the expense of an increased and undesired swing weight.

An overall comparative summary of conventional shaft designs is provided in Table 1 below.

TABLE 1

Comparison of Conventional Shaft Configurations

| Golf Club Characteristic | Steel Shaft | Graphite Shaft | Two Piece Comp/Steel |
|---|---|---|---|
| Total Weight | Heavy | Very Light | Light |
| Swing Weight | D (Note 1) | D (Note 1)<br>E (Note 2) | E to F |
| Bending Stiffness | Excellent<br>Variable | Poor<br>Stiff | Excellent<br>Variable |
| Torsional Stiffness | Excellent (Stiff) | Poor (Soft) | Excellent (Stiff) |
| Damping | Poor | Excellent | Excellent |

Notes:
(1) Rubber Grip
(2) Gripless

Thus, there is a need for a shaft that possesses the attributes indicated above without compromising others. The present invention fulfills this need among others.

SUMMARY OF THE INVENTION

The present invention provides for a golf club having a shaft of multiple sections which have a linear weight less than that of a conventional steel shaft and which are configured to contribute different properties to the club such that optimal overall club performance is achieved. In particular, high torsional stiffness and moderate swing weight are achieved synergistically by configuring the narrow section of the shaft that connects to the hossel of the head such that its linear weight is less than that of a conventional steel shaft while maintaining comparable torsional stiffness. It has been found that linear weight may be decreased while maintaining torsional stiffness by exploiting the difference between linear weight and torsional stiffness as functions of wall thickness and diameter. That is, for a given wall thickness, torsional stiffness increases more than linear weight for a given increase in diameter. Furthermore, torsional stiffness can be increased by constructing the section of a relatively-high shear modulus material such as steel. Thus, a relatively-low linear weight section with torsional stiffness comparable to that of a conventional steel shaft can be provided by increasing shaft diameter and reducing wall thickness in the proper proportions.

To reduce club weight, a majority section of the shaft comprises a lightweight material such as graphite. This section also may have a conically-shaped butt end with an enlarged diameter to provide a comfortable and secure grip for the user without the need for a conventional grip which adds considerable weight to the club. The lightweight shaft translates to greater swing velocity and commensurately further distance on a drive.

Improved vibration dampening is achieved through the use of known energy-absorbing materials in the shaft sections. A synergistic result is realized if the lightweight material used in the majority section of the shaft is also energy absorbing as is graphite. Furthermore, the use of a connector for joining the shaft to the hossel of the head has been found to be effective in dampening vibration, particularly if it is formed of an energy absorbing material like graphite. This connector also has the synergistic feature of dispersing load along a greater area of the shaft section, thereby reducing stress at the joint of the shaft and head. Vibration dampening also may be improved through the use of one or more stiffeners or plugs which are disposed in a shaft section to resist radial deformation thereto.

Variable bending stiffness is achieved by varying the relative lengths of the sections. More specifically, since the section near the hossel of the club is the most narrow part of the shaft and preferably comprises a bendable material such as steel, the relative length and diameter of this section determines the overall flexibility of the shaft. Accordingly, if a more flexible or stiffer club is desired, then the length of this section can be increased or decreased respectively. Furthermore, it has been found that the bending performance of the shaft can be adjusted through the use of one or more stiffeners as mentioned above. Thus, stiffeners have the synergistic result of not only dampening vibration but also stiffening the club, particularly if disposed in the narrow section of the shaft.

Thus, in accordance with the present invention, by controlling the relative lengths, wall thicknesses and material properties of the shaft sections, a club can be configured having the lightweight and vibration damping of a graphite shaft, as well as the wide range of bending stiffness properties and high torsional stiffness of a steel shaft without an excessively high swing weight. With respect to the comparison in Table 1, the club of the present invention has a very light total weight, a moderate D5 to E5 swing weight, excellent (variable) bending stiffness, excellent torsional stiffness, and excellent vibration dampening.

One aspect of the invention is a shaft for attachment to a club comprising sections of different material with a low-weight section connected to the head. In a preferred embodiment, the said shaft comprises: (a) a first section comprising a first material and having a hossel end and a first joint end, the first section having a linear weight no greater than 2.4 g/in; (b) a second section comprising a second material and having a butt end and a second joint end, the second joint end being connected to the first joint end; (c) wherein the second material is less dense than the first material; and (d) wherein the first material has a shear modulus greater than that of the second material.

Another aspect of the invention is a golf club having the shaft as described above. In a preferred embodiment, the golf club comprises: (a) a head having a hossel; (b) a first section comprising a first material and having a hossel end and a first joint end, the first section having a linear weight no greater than 2.4 g/in; (c) a connector for connecting the first section to the hossel; (d) a second section comprising a second material and having a butt end and a second joint end, the second joint end being connected to the first joint end; (e) wherein the second material is less dense than the first material; and (f) wherein the first material has a shear modulus greater than that of the second material.

Yet another aspect is a method of modifying a conventional graphite shaft with a custom section near the hossel. In a preferred embodiment, the method comprises: (a) providing a first section of shaft having a linear weight no greater than about 2.4 g/in, and comprising a first material having a shear modulus greater than that of graphite; (b) providing a graphite shaft having a butt end and a hossel end; (c) removing a certain length of the graphite shaft from its hossel end; and (d) interengaging the first section with the end of the graphite shaft from which the certain length of shaft was removed.

Still another aspect of the present invention is a customized section adapted for connection to a hossel of a club head and a section of a graphite shaft. In a preferred embodiment, the customized section has a linear weight no greater than about 2.4 g/in and comprises a first material having a shear modulus greater than that of graphite.

BRIEF DESCRIPTION OF THE DRAWINGS

The invention may best be understood by reference to the following description taken in conjunction with the accompanying drawings, wherein like reference numerals identify like elements, and wherein.

DETAILED DESCRIPTION OF PREFERRED EMBODIMENT

Referring now to the figures, a discussion of the above features with respect to preferred embodiments is provided below. It should be understood that such embodiments are for illustrative purposes, and should not be construed as limiting the scope of the invention.

Figure 1:
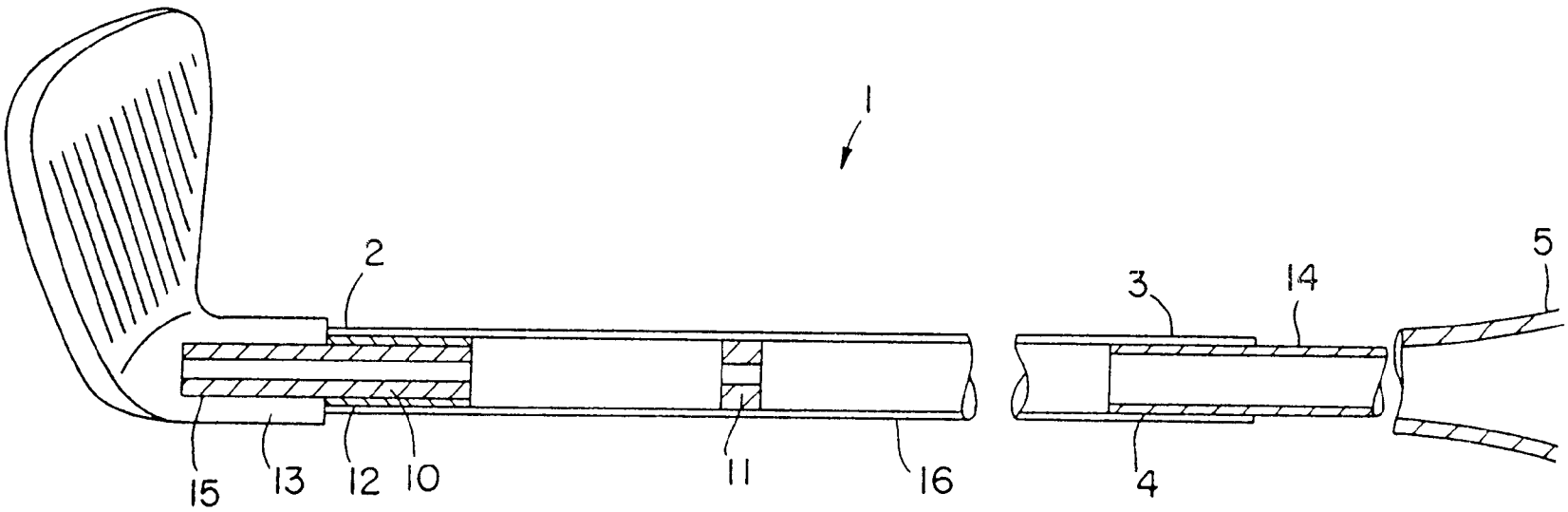
FIG. 1 shows a longitudinal cross-sectional view of a preferred embodiment of a golf club having a hybrid shaft according to the invention.

FIG. 1 illustrates a preferred embodiment of a hybrid shaft 1 which can be used with a driver (wood) or an iron. The hybrid shaft 1 comprises a first section 16 and a second section 14. The first section 16 has a hossel end 2 and a joint end 3. The hossel end 2 is connected to a hossel 13 of a club head 6 via a connector 15. The first section has a linear weight less than that of a comparable section of a conventional steel shaft and comprises a material having a shear modulus greater than that of the material of the second section. The second section comprises a lightweight material and has a joint end 4 which connects to the joint end 3 of the first section 16 and a butt end 5.

The first section imparts torsional stiffness and bending flexibility to the shaft while maintaining a moderate swing weight compared to prior art hybrid shafts. The swing weight is minimized by configuring the first section to have a linear weight less than that of traditional steel shafts. A traditional steel shaft typically has a linear weight of 2.48 g/in, which corresponds to a steel tubular section having an outside diameter (O.D.) of 0.335" and a wall thickness of 0.020". Preferably, the linear weight of the first section is no greater than about 2.4 g/in, more preferably, no greater than about 2 g/in, still more preferably no greater than about 1.9 g/in, and even more preferably no greater than about 1.8 g/in.

To achieve lower linear weight, it is preferable for the wall of the shaft section to be thinner than that of a comparable portion of a conventional shaft since linear weight is proportional to the area of the shaft cross-section. Countering the preference for a low linear weight, however, is the need for torsional stiffness. Torsional stiffness is proportional to both the shear modulus of the shaft material and the polar moment of inertia of the tubular shaft. Since the hossel end of the shaft is the most narrow, and, thus, has the least polar moment of inertia, it is usually this section that dictates the overall torsional stiffness of the club. Accordingly, a torsionally-stiff club requires that the section along the hossel be stiff. The present invention provides for a relatively-thin walled shaft having high torsional stiffness by exploiting the difference between linear weight and torsional stiffness as functions of wall thickness and diameter. That is, for a given wall thickness, torsional stiffness increases more than linear weight for a given increase in diameter. Therefore, by using a material having a shear modulus higher than that of the material of the second section and by increasing the diameter of the hossel end, a thin-walled section of shaft can be used without compromising torsional stiffness.

The material used is preferably a high-shear modulus material which also is bendable. Suitable materials include, for example, steel and metal alloys. Preferably, the material is a heat-treatable steel such as 1050 steel or 4130 steel. To provide corrosion and oxidation resistence, it may be preferably to apply a conventional protective coating to this section.

In a preferred embodiment, the outside diameter (O.D.) of the shaft is preferably no less than about 0.4", more preferably, no less than about 0.42", and even more preferably no less than 0.45". The thickness of the shaft section should be such that the section's torsional stiffness is no less than about that of a conventional steel shaft having an O.D. of 0.335" and a wall thickness of 0.020". Accordingly, adequate torsional stiffness can be maintained with a thinner-walled section if O.D. increases. For example, steel sections having O.D.s of 0.42" and 0.458" O.D. and wall thicknesses of 0.010" and 0.008", respectively, have adequate torsional stiffness.

Although a greater diameter can compensate for a thinner-wall shaft section, the wall thickness should not be so thin that club durability suffers. In other words, an excessively thin-walled section may be dented or bent too easily. It has been found that adequate durability is maintained with a steel section having a wall thickness of no less than about 0.07", preferably no less than about 0.08", and more preferably no less than about 0.09".

The strength of the section may be improved by heat treating. Preferably, the section is tempered such that its Rockwell Hardness is no less than about $R_c$ 45, and more preferably no less than about $R_c$ 48. Suitable tempering techniques are known in the art and include, for example, heating the steel section by submersing it in a molten salt bath or by induction heating (preferred for longer sections), and then quenching it in a room-temperature oil bath or the like.

Therefore, the first section of the present invention may be configured to reduce swing weight by reducing wall-thickness, to maintain torsional stiffness by increasing wall diameter, and to be durable by heat treating and maintaining a minimum wall-thickness. One skilled in the art may alter the section's diameter and thickness to optimize these characteristics In addition to lowering the linear weight of the first section, the swing weight of the club may be reduced through other approaches, including, for example, shortening the club, reducing weight in the head or the head end of the shaft, adding weight to the butt end and combinations of two or more thereof.

The hossel end of the first section is connected to the hossel of the head with a connector. A suitable connector cooperates with the first section and the hossel to facilitate interengagement. Preferably, the connector provides a lap joint with the first section to distribute the stress of the joint over a greater area. This is particular important with thin-walled shaft sections, as described above, which tend to deform more readily. Preferably, the lap joint extends in from the hossel end at least about 0.5", and, more preferably, at least about 1".

To provide a lap joint, the connector may be, for example, an internal stub shaft, an external sleeve, or an extension extending either from the hossel end into and/or around the hossel or from the hossel into and/or around the hossel end. The lap joint may be secured with adhesive, a weld, a bushing, an interference fit, screw engagement (cooperating threads), snapping or latching engagement, crimping engagement, spline and groove engagement, and combinations of two or more thereof. Preferably, the connector is an internal stub shaft secured by a bushing and epoxied in place. Alternatively, the need for a bushing may be eliminated if the connector is stepped such that its O.D. narrows from a larger diameter section to a narrower diameter section. The larger diameter section is adapted for insertion in the shaft and the narrower diameter section is adapted for insertion in the hossel.

By forming the stub shaft of a vibration absorbing material, the synergistic result of both connecting the first section to the hossel and dampening vibration can be realized. Suitable materials include, for example, polymeric composites, such as graphite/resin and fiberglass/resin, ceramics, and plastics. Preferably, the stub shaft comprises a graphite/resin composite.

Referring to the preferred embodiment shown in FIG. 1, the connector 15 is a stub shaft 10 having an O.D. of 0.335". One end of the stub shaft 10 is epoxy bonded to the interior of the hossel 13 having a standard ID dimension of 0.340". The O.D. of the bushing 12 is epoxy bonded to the interior of the first section of the shaft. The stub shaft 10 and bushing 12 are also epoxy bonded to each other.

As suggested by FIG. 1, second section 14 preferably comprises the majority of the length of the hybrid shaft and, therefore, largely determines the weight and vibration damping of the club. The second section may comprise a variety of materials and combinations thereof providing that the second section is strong, rigid and relatively light compared to a comparable portion of a conventional steel section. Suitable materials include, for example, composite materials such as graphite fiber/resin and fiberglass/resin; metals such as aluminum, steel alloys and titanium; ceramics; polymeric materials such as thermoset plastics; and/or combinations of two or more thereof. In general, moldable materials that lend flexibility to the second section's size and shape are preferred. Graphite fiber composites are more preferred from a cost, strength, flexibility and commercial-availability perspective.

It may be preferable that the second section 14 be patterned after the "gripless" shaft design, having an integrally formed, enlarged grip 26 with a tapered conical section affording a secure hand hold to the golfer. The gripping surface eliminates the need for a traditional "grip" that adds a considerable amount of weight to the club and raises the club's center of gravity away from the head. The gripping surface should have a size and shape to accommodate a user's grip. This includes conventional grip configurations as well as custom configurations to meet a user's particular requirements.

In one embodiment, the gripping surface has a size and shape substantially similar to conventional grips. Although variations exist throughout the industry, a conventional grip is about 10.0 to about 10.5" in length with a single longitudinal axis. The gripping surface typically has an outer diameter at its largest point of at least about 0.8". Furthermore, conventional grips usually are tapered such that the second end has a cross-sectional area greater than that of the first end. This taper may be either linear or nonlinear. A preferred taper is approximately 0.03"/in. In a more preferred embodiment, the taper is greater near the second end of the grip thus forming a "trumpeted" butt end. Such profiles are well known in the manufacture of grips.

Another embodiment of the invention comprises a gripping surface configured for a user's particular needs. This includes oversized grips, undersized grips, grips having cross-sectional areas other than circular, grips having more than one longitudinal axis, curved grips, grips having grooves, ridges, and/or bumps, and other grips having a size or form that a particular user may prefer. For example, if the user has large hands or arthritis, he or she may prefer a gripping surface larger than a conventional grip.

The second section can be adapted readily for an extra-large gripping surface because as the diameter of the second section increases so does its rigidity. Consequently, thinner wall construction is possible which reduces weight. Therefore, unlike the prior art, a larger grip can be used with little or no added weight.

To enhance gripping, the gripping surface may be treated to increase friction with the user's hands. Suitable treatments include, for example, texturing, mild adhesives or sticky coatings, and thin tapes. In a preferred embodiment, the treatment comprises a grip or thin tape wrapping comprising a polymer surface which absorbs perspiration and is tacky to the touch. It should be noted that the preferred surface treatment adds little weight and thickness to the second section. For example, a preferred tape wrapping may only add from about 5 to about 15 g to the shaft and have a thickness from about 0.010 to about 0.050".

The relatively large diameter of the second section, in addition to accommodating the golfer's hands comfortably, accounts for the advantageous torsional stiffness since torsional stiffness is proportional to the polar moment of inertia which is exponentially related to diameter. A high bending stiffness also results from the large diameter, since the bending stiffness is proportional to the area moment of inertia which is proportional to the square of the diameter of a circular section The location of the joint between the first and second sections along the shaft depends on primarily two factors. First, the polar moment of inertia of the second section at the joint end should be sufficient such that the torsional stiffness at the joint end is at least that of the first section at the hossel end (the most narrow section of the shaft). In other words, the torsional stiffness at the hossel end should be the lowest along the shaft and therefore dictate the overall torsional stiffness of the club. Although the second section comprises a material having a shear modulus lower than that on the first section, the greater cross-sectional area of the second section (due to the shaft's taper) should be sufficient to compensate for it. For example, a graphite shaft having an O.D. of 0.400" and a thickness of 0.05" has approximately the same torsional stiffness as a conventional steel section at the hossel (0.355" O.D., 0.020" wall thickness).

Second, the location of the joint should be established to provide the user with the desired bending flexibility. That is, since the first section tends to be more flexible in bending than the second section, a shaft having a longer length of the first section will tend to bend more readily. One skilled in the art can determine readily the relative lengths of the shaft sections to achieve the desired bending stiffness of the shaft. Preferably, the first section accounts for about 10 to about 49% of said total shaft length, and the second section accounts for about 51 to about 90% of said total shaft length. More preferably, the first section accounts for about 30 to about 45% of said total shaft length, and said second section accounts for about 70 to about 55% of said total shaft length. For example, suitable results have been obtained with a 41.5" long hybrid shaft having a second section of graphite of 22.25" and a first section of steel of 19.25", and with a 42" long hybrid shaft having a second section of graphite of 28.25" and a first section of steel of 13.75".

The two sections may be attached using any conventional mechanism for connecting two tubular objects together as described above with respect to the connector. Preferred configurations for connecting the two sections are shown in detail in FIGS. 2*a*–2*e* and 3*a*–3*e*.

Figure 2A:
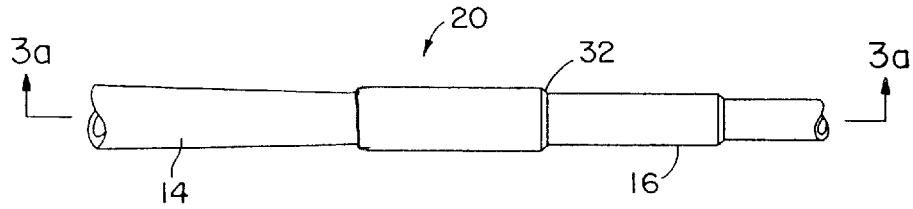
FIG. 2*a* shows a partial view of the joint region of a hybrid shaft, showing a first type of joint according to the invention.
Figure 3A:
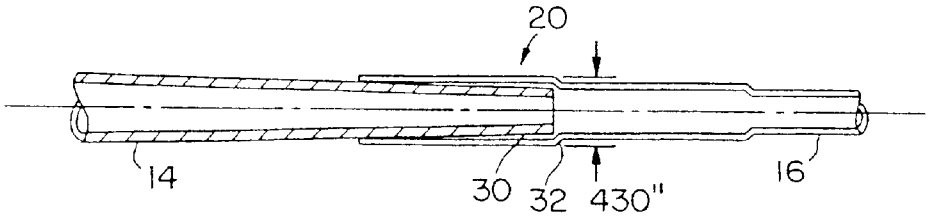
FIG. 3*a* shows a longitudinal sectional view, taken along line 3*a*—3*a* of FIG. 2*a;*

FIGS. 2*a* and 3*a* depict a lap joint attachment with the second section 14 inserted into the first section 16 and secured by a layer of adhesive 30, for example a sand-filled epoxy. FIG. 3*a* shows a longitudinal sectional view of the lap joint of FIG. 2*a*. Second section 14 comprises a tapering graphite shaft and first section 16 comprises a stepwise tapering steel shaft traditionally associated with golf club shafts. The steel shaft could be specially fabricated for this construction or trimmed from an existing steel shaft club. The engagement length of the joint region 20 is about 2" and second section 14 is inserted until it bottoms on the first step down 32 from the mating diameter of the first section 16. Because the steel shaft comprising the first section 16 can accept a relatively large diameter second section, this joint configuration is best suited for clubs having relatively thick walls which are relatively stiff in bending. High torsional stiffness is assured by the use of steel at the hossel end of the shaft.

Figure 2B:
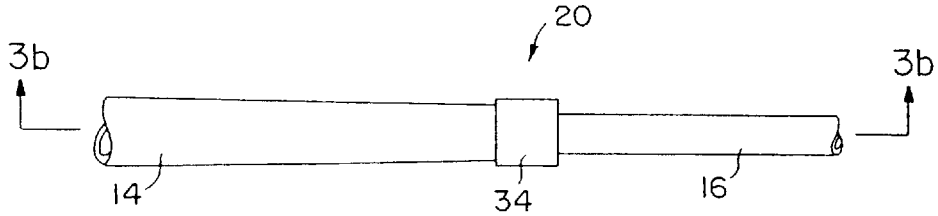
FIG. 2*b* shows a partial view of the joint region of a hybrid shaft, showing a second type of joint according to the invention.
Figure 3B:
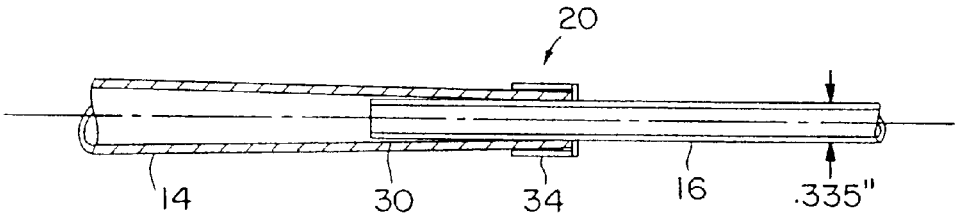
FIG. 3*b* shows a longitudinal sectional view of taken along line 3*b*—3*b* of FIG. 2*b;*

FIG. 2*b* and its associated FIG. 3*b* showing a longitudinal sectional view depict a lap joint wherein the first section 16 (steel) is inserted into the second section 14 (graphite) and secured therein by an adhesive layer 30, for example sand-filled epoxy. Preferably, the first section is modified steel section. The engagement length of the joint region 20 is about 2" long and a reinforcing ferrule 34 is positioned at the joint over the end of second section 14. Ferrule 34 circumferentially reinforces the end of second section 14 and prevents it from splitting when load is applied to the joint. Ferrule 34 is used because the graphite comprising the second section has low strength in the hoop direction (circumferentially), and is especially weak near the end. The ferrule is made from steel and swaged in place on the shaft, although other materials and attachment means would also be effective. This particular joint works well with relatively thin walled graphite second sections to form a relatively flexible club best suited for senior or women golfers.

Figure 2C:
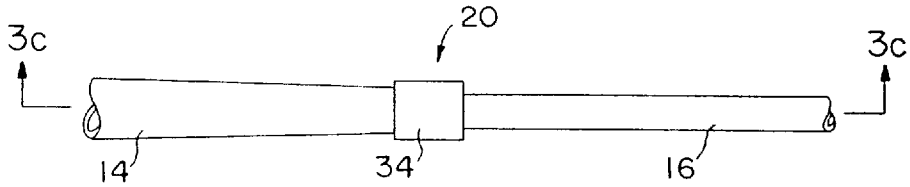
FIG. 2*c* shows a partial view of the joint region of a hybrid shaft, showing a third type of joint according to the invention.
Figure 3C:
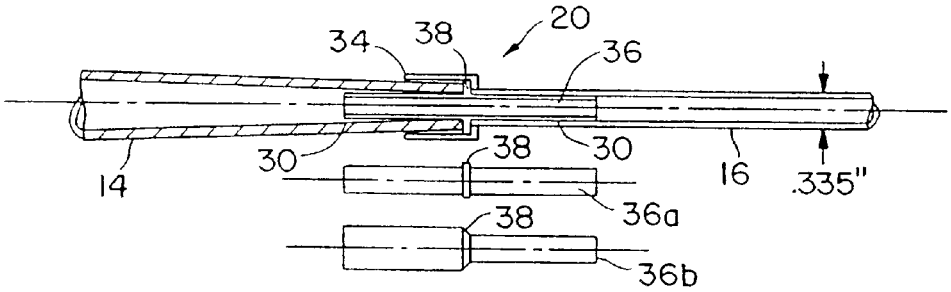
FIG. 3*c* shows a longitudinal sectional view taken along lines 3*c*—3*c* of FIG. 2*c;*

FIGS. 2*c* and 3*c* show a joint region 20 formed by a butt joint using an internal sleeve 36. Internal sleeve 36 is formed from a short section hollow steel tube having an outer diameter sized to interfit within the first and second sections. The total engagement length for this joint is about 3 inches. Internal sleeve 36 can have a constant cross section as seen at 36*a* to engage shaft segments having equal internal diameters or the cross section of the sleeve can vary in a stepwise fashion as shown at 36*b* to afford a transition from a relatively large diameter second section to a smaller diameter first section. Internal sleeve 36 is retained to the segments by means of an adhesive layer 30 and has an external shoulder 38 extending circumferentially around the sleeve. One or both of the shaft segments butt against the shoulder when the sleeve interengages the segments. A reinforcing ferrule 34 is again used to reinforce the end of the graphite second section 14 and prevent the shaft from splitting under load.

Figure 2D:
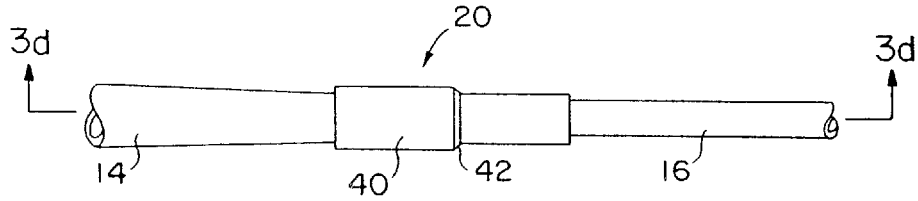
FIG. 2*d* shows a partial view of the joint region of a hybrid shaft, showing a fourth type of joint according to the invention.
Figure 3D:
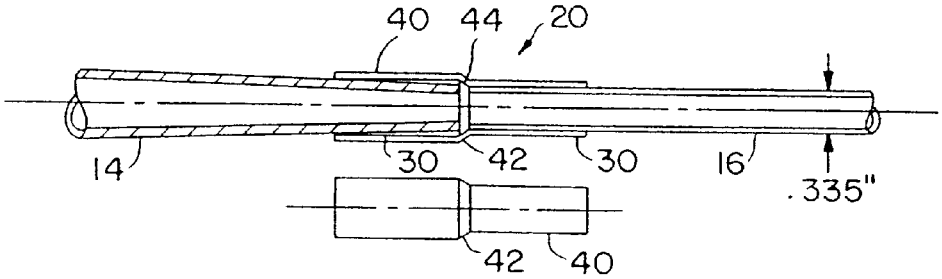
FIG. 3*d* shows a longitudinal sectional view taken along lines 3*d*—3*d* of FIG. 2*d*.

FIGS. 2*d* and 3*d* show a butt joint region 20 formed by an external sleeve 40. External sleeve 40 is formed from steel and sized with a stepwise sectional transition forming an internal shoulder 42 to accept first and second club segments having different outer diameters. The joint engagement length is about 3 inches and the shaft segments are retained within external sleeve 40 by means of an adhesive layer 30. A small disk 44 with a center vent hole is installed at the integral shoulder 42 to prevent the first section 16 from sliding inside second section 14 if the selected shaft diameters allow this to happen. Second section 16 butts against either disk 44 or shoulder 42 when engaging external sleeve 40. The external sleeve joint has great flexibility in that it can be used to mate graphite and steel sections having a wide variety of diameters to produce hybrid shafts with a wide range of characteristics.

Figure 2E:
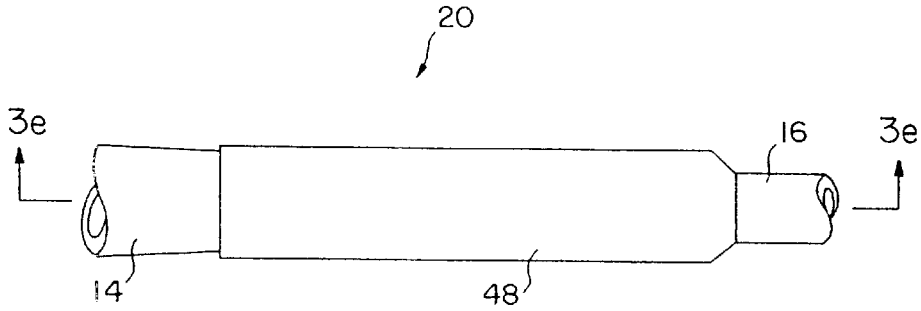
FIG. 2*e* shows a partial view of the joint region of a hybrid shaft, showing a fifth type of joint according to the invention.
Figure 3E:
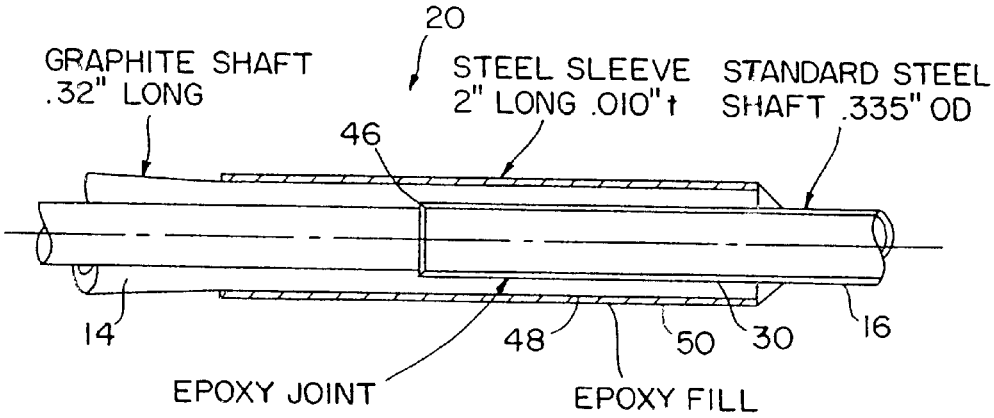
FIG. 3*e* shows a longitudinal sectional view taken along lines 3*e*—3*e* of FIG. 2*e*.

FIGS. 2*e* and 3*e* depict a joint region 20 which combines the features of a lap joint with an external sleeve design. Second section 14 is bored out to accept first section 16 in mating interengagement. Boring second section 14 produces a shoulder 46 against which first section 16 butts. An adhesive layer 30 secures the shaft segments to one another. The joint is reinforced by an elongated external sleeve 48, preferably of steel, which extends along second section 14 over a length approximately twice the engagement length of the joint. Sleeve 48 is secured to the second section by an adhesive layer 50. The sleeve is used to support the graphite fibers over the length of the joint region 20 and to transfer loads to the adjoining section of the second section unaffected by the internal bore. This joint design is used to fabricate clubs having the lightest total weight and relatively small swing weights because it allows the second section to be relatively longer than other designs and still achieve an effective and secure joint to the first section which is typically of a much smaller diameter.

Referring back to FIG. 1, a stiffener 11 is shown. One or more stiffeners 11 may be inserted into the shaft to resist radial deformation thereto. By so doing, the stiffeners dampen vibration and tend to increase the shaft's bending stiffness. Stiffeners 11 may comprise any compression-resilient device inserted in either shaft section to prevent or resist the section's radial deformation. Suitable stiffeners include, for example, hollow plugs or tubular sections of wood, polymeric materials, and polymeric composites. Preferably, the stiffeners comprise a graphite.

What is claimed is:

1. A golf shaft for attachment to a hosel of a club head, said shaft comprising:

a first section comprising a first material and having a hosel end and a first joint end, said first section having a linear weight no greater than 2.4 g/n;

a second section comprising a second material and having a butt end and a second joint end, said second joint end being connected to said first joint end;

wherein said second material is less dense than said first material;

wherein said first material has a shear modulus greater than that of said second material; and a stub adapted to be insertable in said hosel and said first section such that said first section and said hosel are butt joined, said stub comprising a composite material.

2. The shaft of claim 1, wherein said stub comprises graphite.

3. The shaft of claim 1, wherein said linear weight of said first section is no greater than about 2 g/in.

4. The shaft of claim 3, wherein said linear weight of said first section is no greater than about 1.8 g/in.

5. The shaft of claim 4, wherein said weight per inch of said first section is no greater than about 1.7 g/in.

6. The shaft of claim 1, wherein said first section is about 10 to about 40% of said total shaft length, and said second section is about 60 to about 90% of said total shaft length.

7. The shaft of claim 1, wherein second section comprises a composite material.

8. The shaft of claim 7, wherein said second section comprises graphite.

9. The shaft of claim 1, wherein said first section comprises steel.

10. The shaft of claim 1, further comprising internal stiffeners in the steel section to provide vibration damping.

11. A golf shaft for attachment to a hosel of a club head, said shaft comprising:

a first section comprising a first material and having a hosel end and a first joint end, said first section having a linear weight no greater than 2.4 g/n, wherein said first section has an outside diameter of no less than about 0.420";

a second section comprising a second material and having a butt end and a second joint end, said second joint end being connected to said first joint end;

wherein said second material is less dense than said first material; and wherein said first material has a shear modulus greater than that of said second material.

12. The shaft of claim 11, wherein said linear weight of said first section is no greater than about 2 g/in.

13. The shaft of claim 12, wherein said linear weight of said first section is no greater than about 1.8 g/in.

14. The shaft of claim 13, wherein said weight per inch of said first section is no greater than about 1.7 g/in.

15. The shaft of claim 11, wherein said section has an outside diameter greater than about 0.335".

16. The shaft of claim 11, wherein said first section is about 10 to about 40% of said total shaft length, and said second section is about 60 to about 90% of said total shaft length.

17. The shaft of claim 11, wherein second section comprises a composite material.

18. The shaft of claim 17, wherein said second section comprises graphite.

19. The shaft of claim 11, wherein said first section comprises steel.

20. The shaft of claim 11, further comprising internal stiffeners in the steel section to provide vibration damping.

21. A golf shaft for attachment to a hosel of a club head, said shaft comprising:

a first section comprising a first material and having a hosel end and a first joint end, said first section having a linear weight no greater than 2.4 g/n;

a second section comprising a second material and having a butt end and a second joint end, said second joint end being connected to said first joint end;

wherein said first and second sections have a torsional stiffness no less than that of a 0.355" O.D., 0.020" thick, steel tube;

wherein said second material is less dense than said first material; and wherein said first material has a shear modulus greater than that of said second material.

22. A golf club comprising:

a head having a hosel;

a first section comprising a first material and having a hosel end and a first joint end, said first section having a linear weight no greater than 2.4 g/n;

a connector for connecting said first section to said hosel;

a second section comprising a second material and having a butt end and a second joint end, said second joint end being connected to said first joint end;

wherein said first and second sections have a torsional stiffness no less than that of a 0.355" O.D., 0.020" thick, steel tube;

wherein said second material is less dense than said first material; and wherein said first material has a shear modulus greater than that of said second material.

23. The shaft of claim 22, wherein said linear weight of said first section is no greater than about 2 g/in.

24. The shaft of claim 23, wherein said linear weight of said first section is no greater than about 1.8 g/in.

25. The shaft of claim 24, wherein said weight per inch of said first section is no greater than about 1.7 g/in.

26. The shaft of claim 22, wherein said section has an outside diameter greater than about 0.335".

27. The shaft of claim 22, wherein said first section is about 10 to about 40% of said total shaft length, and said second section is about 60 to about 90% of said total shaft length.

28. The shaft of claim 22, wherein second section comprises a composite material.

29. The shaft of claim 28, wherein said second section comprises graphite.

30. The shaft of claim 22, wherein said first section comprises steel.

31. The shaft of claim 22, further comprising internal stiffeners in the steel section to provide vibration damping.

* * * * *